United States Patent [19]

Riley

[11] Patent Number: 4,892,980

[45] Date of Patent: Jan. 9, 1990

[54] DUAL CONTACTS ON VOLTAGE RAIL

[75] Inventor: Ron Riley, Grand Blanc, Mich.

[73] Assignee: J. N. Fauver Company, Madison Heights, Mich.

[21] Appl. No.: 227,704

[22] Filed: Aug. 3, 1988

[51] Int. Cl.[4] ..... B60L 5/04; B60L 5/38

[52] U.S. Cl. ..... 191/14; 191/58; 246/66; 246/73

[58] Field of Search ..... 191/14, 15, 57, 58; 246/65, 73, 9, 11, 66–68, 86, 87, 254

[56] References Cited

U.S. PATENT DOCUMENTS

| | | | |
|---|---|---|---|
| 558,033 | 4/1896 | Brinckerhoff | 191/15 |
| 1,544,882 | 7/1925 | Bethenod | 246/68 |
| 2,214,924 | 9/1940 | Griffiths et al. | 246/67 |

FOREIGN PATENT DOCUMENTS

| | | | |
|---|---|---|---|
| 646243 | 7/1964 | Belgium | 246/66 |
| 17492 | 4/1913 | France | 191/14 |
| 771833 | 10/1934 | France | 246/65 |
| 777469 | 2/1935 | France | 246/67 |
| 365797 | 12/1938 | Italy | 191/14 |

*Primary Examiner*—Andres Kashnikow
*Assistant Examiner*—Mark T. Le
*Attorney, Agent, or Firm*—Reising, Ethington, Barnard, Perry & Milton

[57] ABSTRACT

The invention is a conveyor assembly (10) having a vehicle (12) which moves about a track (18). The track (18) includes rails (20) extending therealong for supplying power and command signals to the vehicle (12). The rails (20) are separated into isolated sections separated by buffers (24) with each section supplying electrical signals. The vehicle (12) includes at least two contacting pads (32, 33) for contacting a rail (20) and conducting the electrical signal on the rail (20) to the vehicle (12). The contracting pads are spaced a distance such that at least one contacting pad (32, 33) is in electrical connection with the rail (20) so that the vehicle (12) continuously receives the electrical signals. The receiver (34) of the vehicle (12) receives the signals from both contacting pads (32, 33) and combines the signals while preventing back feeding to the other contact pad (32, 33).

36 Claims, 5 Drawing Sheets

DUAL CONTACTS ON VOLTAGE RAIL

TECHNICAL FIELD

The invention relates to a conveyor assembly using automatic, self-propelled vehicles which move along a track and receive signals from conductive rails along the track. More specifically, a vehicle having contact pads for continuously receiving electrical signals from the rails while preventing back feeding.

BACKGROUND OF THE INVENTION

Self-propelled trolley vehicles of conveyor systems receive power and command signals off rails along the rack. Since power attenuates as the rail length increases due to small resistances, the rails are isolated into sections with signals supplied to each section. Therefore, vehicles which move along the sectioned track include pads contacting the rails for supply electrical signals or power to the vehicle. A pad always need to be in contact with the powered section of the rail in order to continuously supply the signals. When only a single contact pad is used, the vehicle will not receive electrical signals when over a buffer isolating the sections of rail. There are systems which use a plurality of contacting pads, wherein one pad is allowed to conduct power at a time.

One such system discloses an electric car having a pair of contact shoes which straddle the ends of two or more rail sections. Such a system is disclosed in U.S. Pat. No. 759,453 granted May 10, 1904 issued to Mahoney. These rail sections, however, are not isolated from each other. The middle rail is a closed circuit and when the vehicle passes over a section brake, it lifts the plate via magnets which brake the circuit. The circuit is completed by passing the currents through the vehicle which allows the electricity to power the vehicle motor. This prior system does not disclose any prevention of feedback through the second contacts nor with the possibility of the vehicle losing power when one or more contacts rests on a buffer.

Another such system is disclosed in U.S. Pat. No. 3,083,296 issued Nov. 21, 1960 in the name of R. A. Bradley. This system includes a train having at least two carriages. The rails are divided and alternate power and non-power sections. Each carriage has a relay and connects such that when the first carriage is open the powered rail, it conducts the power while the second carriage relay is open and non conducting, and vice verse when the second carriage is over the powered rail. Only one relay is closed at a time.

Therefore, there remains a problem when two or more contact pads are in conduction with the rail which is continuously powered by the power source and separated in section by buffers such that when any contact pad is conducting power from the rail there will not be feedback through the other contact pad and will only power the vehicle.

SUMMARY OF THE INVENTION AND ADVANTAGES

The invention is a method for moving a vehicle along a track and a conveyor assembly which includes a vehicle for moving along a track. The assembly comprises a vehicle being mobile about the track. There are conductive means along the track for supplying an electrical signal to the vehicle. The conductive means comprises isolated sections of rail each transmitting an electrical signal and having buffers between each isolated section for preventing electrical conduction therebetween. The vehicle includes at least two contacting pads placed a distance apart in such that one contacting pad is in electrical connection with the rail. Also included is receiver means for receiving the electrical signal from each contacting pad and for preventing back feeding of the received electrical signal to either contacting pad.

The advantages of the invention include the use of two contacting pads which are spaced a distance apart so when using isolated sections of rail power will always be supplied to the vehicle. Additionally, the receiver means prevents any feedback to either contact pad causing shorting by the power received from one of the contact pads.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
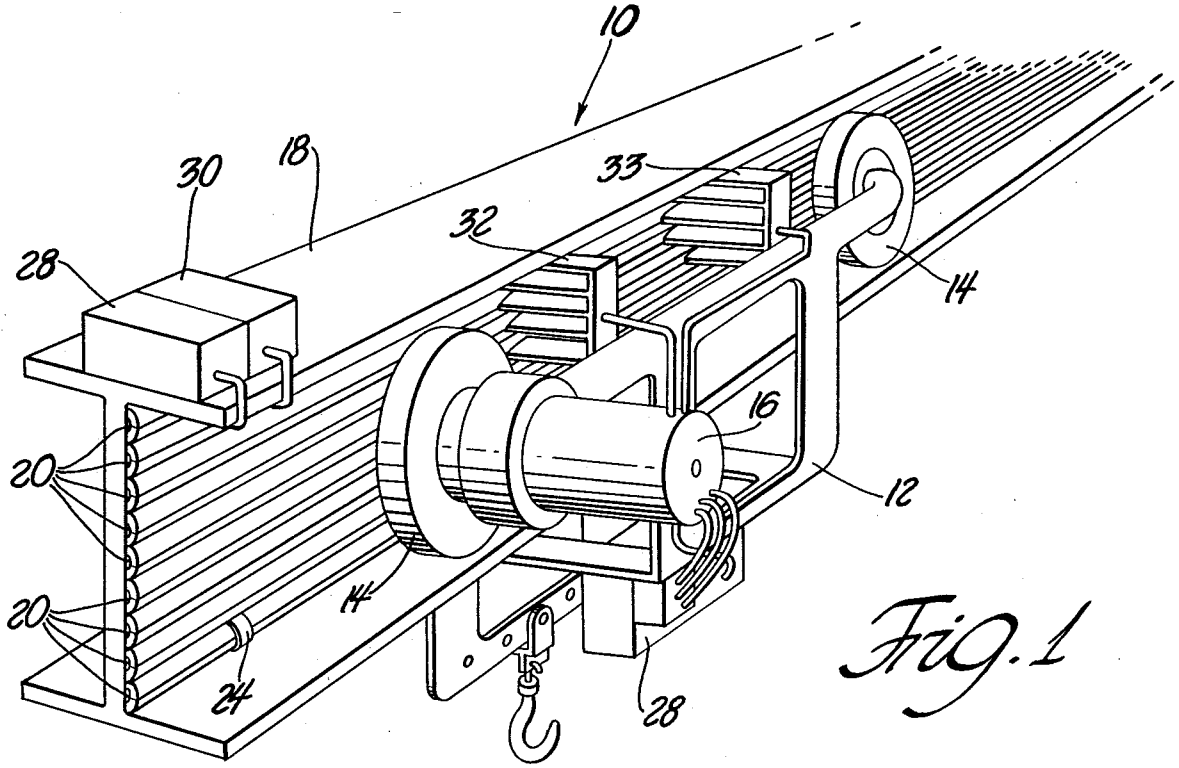
FIG. 1 is a perspective view of the preferred embodiment of the subject invention.

A conveyor control system which is powered from rail voltages is generally shown at 10 in FIG. 1. The conveyor control assembly 10 includes a trolley vehicle 12 which includes wheels 14 for mobility. The vehicle 12 has a variable speed motor 16 for rotating the wheels 14 to drive the vehicle 12 at variable speeds. The motor 16 may be driven by three phase AC power or DC power.

The assembly 10 includes conductive means 20 supported along a track 18 for supplying electrical signals to the vehicle 12. The conductive means 20 includes a plurality of isolated sections of rails 20 with buffers 24 between each section for preventing electrical conduction therebetween. The plurality of rails 20 include power rails supplying power to the motor 16. The power supply rails include three rails 20 wherein each of the three rails carries one phase of the power supply voltage, and a fourth rail as a ground rail. The plurality of rails 20 includes at least one command rail for producing a constant command signal along the command rail which is indicative of requested speed at which the vehicle 12 is to move.

The command rail 20 comprises a plurality of isolated sections of rail for providing one of the command signals by one of the sections of rails as isolated from the command signal on the next adjacent section. The power supply rails are also comprised of a plurality of isolated section of rail with power supplied to each section. The minimum requirement of having an isolated section depends on the length of the track 18 and the rails 20 due to attenuation as the distance increases from the power or signal source and the number of different speeds on the command rail. Sections of rails 20 of both the power rails and command rail are separated by the buffers 24.

The vehicle 12 includes control means 28 which receives the command signal and interprets it to drive the motor 16 to move the vehicle 12 at a requested speed indicative by the control signal. The motor 16 includes an inverter which drives the motor 16 from the control means 26. The control means 28 sends a DC signal to the inverter of the standard type, not shown, which uses the DC signal and the three phase power to modulate the width of pulses which drive the motor 16. The width of the pulse varies the power to the motor 16 which is synchronized to frequency making it a variable speed motor 16.

The assembly 10 also includes power generating means 30 which generates the power supplied to the rails 20 to power the vehicle 12. The assembly 10 further includes command generating means 28 which supplies the command signals to the isolated sections of rail to move the vehicle 12 at the various speeds. The command signal is one of a plurality of requested speeds which effectively drive the motor 16 at various speeds depending upon which the isolated sections of the rail the vehicle 12 is within. The command signal may be in the form of an analog signal, or digital half-wave signal decoded into a binary coded signal by the control means 26 on the vehicle 12, or any other form which indicates speed of a vehicle 12. The command generating means further includes a plurality of reverse and forward directional speeds which moves the vehicle 12 in the reverse or forward direction along the plurality of rails 20 at one of the plurality of requested speeds. In other words, the vehicle 12 driven by the motor 16 can move at various speed in the reverse or forward directions. The polarity of the analog signal indicates forward and reverse directions, and a bit or half-wave of the digital signal indicates forward or reverse directions. The speed the vehicle 12 moves is dependent upon the command signal which is received from the isolated section of rail upon which the vehicle 12 is located. The next isolated section of rail, within which the vehicle 12 is driven may have the requested speed set at a different speed at which the vehicle 12 is to be driven. As an example, the speed differences may be necessary when a vehicle 12 is going on a long straight section of track 18 as opposed to a sharp turn in the track 18. In this case, a higher requested speed signal would be sent along the isolated section of rail on the straight section of the rail and the lower requested speed would be sent along the isolated section of rail along the turn.

The vehicle 12 includes at least two contacting pads 32,33 placed a distance apart along one rail such that at least one contacting pad 32, 33 is always in electrical connection with the rail 20. The contact pads 32, 33 for one of the rails, power rail or command rail, are located longitudinally along the vehicle 12, one behind the other relative to the longitudinal length of the rail. The contacting pads 32, 33 acts as a conductor between the conductive means or rail 20 and the control means 28 on the vehicle 12. When a contacting pad 32, 33 is located on a buffer no power or electrical signal is passed to the contact pad. Therefore, in the case of three phase power, there requires at least two contact pads per rail or per phase and ground. Also, there requires at least two contact pads 32, 33 in electrical connection with the command rail.

The control means 28 includes receiver means 34 for receiving the electrical signal from each contacting pads 32, 33 and for preventing back feeding of the received electrical signal to the other contacting pad 33, 32 to eliminate shorting therebetween. Each of the two contacting pads along a single rail 32, 33 will be connected at a common point within the receiver means 34 to supply a signal to the control means 28 of the vehicle 12. Because of this mutual or common connection, it is imperative that the receiver means 34 be configured to prevent any feedback from one contacting pad 32, 33 to the other contact pad 32, 33.

The receiver means 34 comprises diode logic to receive the electrical signal off one of the contacting pads 32,33 and to prevent back feeding to the other of the contacting pads 32,33. In other words, the diode logic is connected between the contacting pads 32, 33 and the mutual or common connections such that neither signal received by the contacting pads 32, 33 will be able to be transmitted to the other contacting pad 32, 33.

There are four embodiments of the receiver means 34 and diode logic, and it is to be understood that the invention is not limited to these four embodiments, but are merely used for example. The first embodiment FIG. 2 and second embodiment FIG. 3 are used in the application of DC or AC signals being supplied to a rail, respectively. The third embodiment FIG. 4 is used when the digital or halfwave command signal is transmitted along a rail, and the fourth embodiment FIG. 5 is used when the analog command signal is transmitted along a rail.

Figure 2:
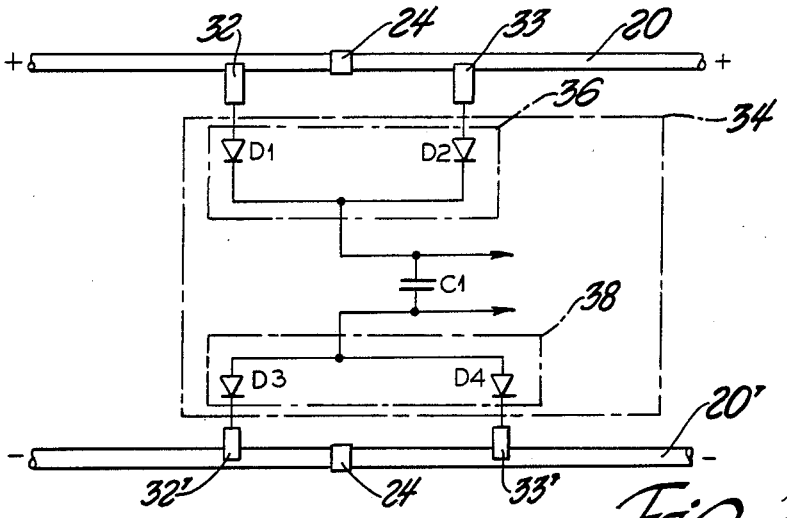
FIG. 2 is a schematic diagram of a first embodiment of the subject invention.
Figure 3:
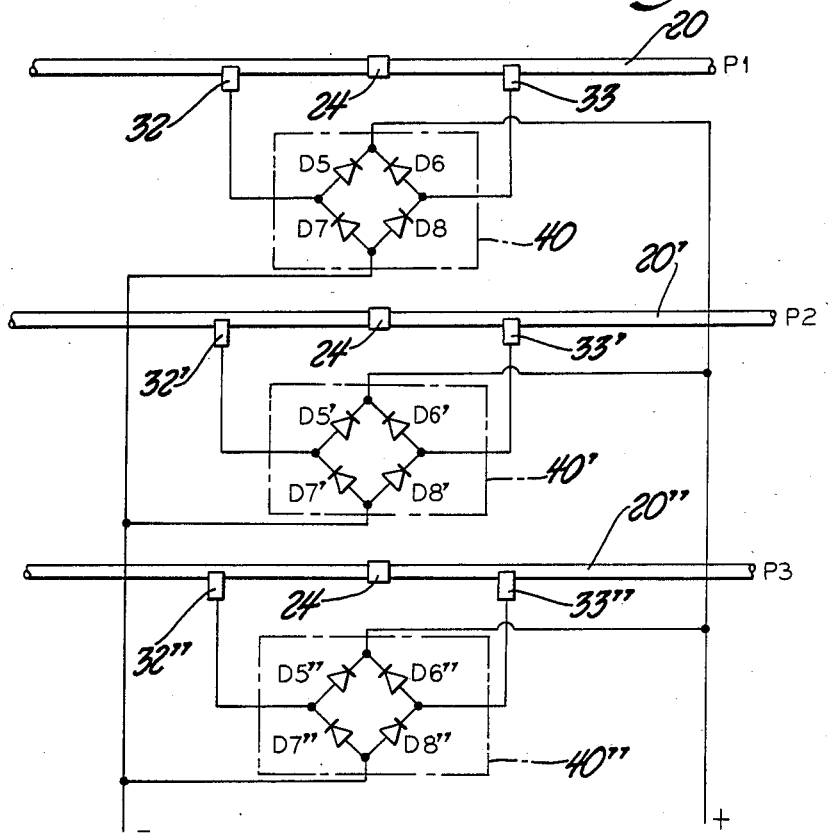
FIG. 3 is a schematic diagram of a second embodiment of the subject invention.

In the first embodiment FIG. 2, the conductive means 20 transmits positive and negative DC signal or power to the vehicle 12. The conductive means includes two rails 20, 20' for transmitting positive polarity and negative polarity DC power to the vehicle 12. The receiver means 34 includes positive power receiver means 36 for receiving power off the positive polarity conductive rail and negative power receiver means 38 for receiving power off the negative polarity conductive rail. There are at least two contacting pads 32, 33 serially along the positive polarity conductive rail 20 and at least two contacting pads 32', 33' serially along the negative polarity conductive rail 20'. The positive power receiver means 36 includes a positive polarity diode D1, D2 connected to each conducting pad 32, 33 with their anodes connected to produce a positive power signal to the vehicle 12. The negative power receiver means 38 includes negative polarity diodes D3, D4 connected to each conduction pad 32', 33' with their cathodes connected to produce a negative power signal to the vehicel 12. As shown in FIG. 2, conducting pads 32, 33 are in contact with the positive polarity rail 20 and each contacting pad 32, 33 is connected to a positive polarity diode D1, D2 having each anode connected at the mutual point. Likewise, conducting pads 32', 33' are in contact with the negative polarity rail 20' and each are connected to the negative polarity diodes D3, D4 whose cathodes are connected in mutual negative points. A capacitor C1 interconnects the positive and negative power signals and each produces the respective power signal to the vehicle 12 and motor 16.

The second embodiment FIG. 3 includes the conducting means 20 transmitting an AC signal or power to the vehicle 12. Again, each phase P1, P2, P3 of the AC power signal includes at least two contacting pads 32, 33, 32', 33', 32", 33" serially along each rail 20, 20', 20". The diode logic 34 includes full-wave rectifier means 40 for rectifying the AC signal. The full-wave rectifier 40 comprises first D5 and second D6 positive polarity diodes and with a respective cathode connected to one of the conducting pads 32, 33 and with their anodes connected to supply the positive power signal to the vehicle 12. First D7 and second D8 negative polarity diodes have their anodes connected to one of the conducting pads 32, 33 and their cathodes connected to supply the negative power signal to the vehicle 12. The diode logic 34 may include the full-wave rectifier 40, 40', 40" for each of three phases of power signal with each phase transmitted on a separate rail 20, 20', 20". The specific circuitry is the same and is indicated as such by respective primed numbers. In this case, the positive power signals from each phase rail 20, 20', 20" are connected to produce the positive power signal to the vehicle 12 as are the negative power signals from each phase rail 20, 20', 20" are connected to produce the negative power signal to supply power to the vehicle 12. As shown in FIG. 3, a rectifier 40 supplies the positive and negative signals to the vehicle 12.

Figure 4:
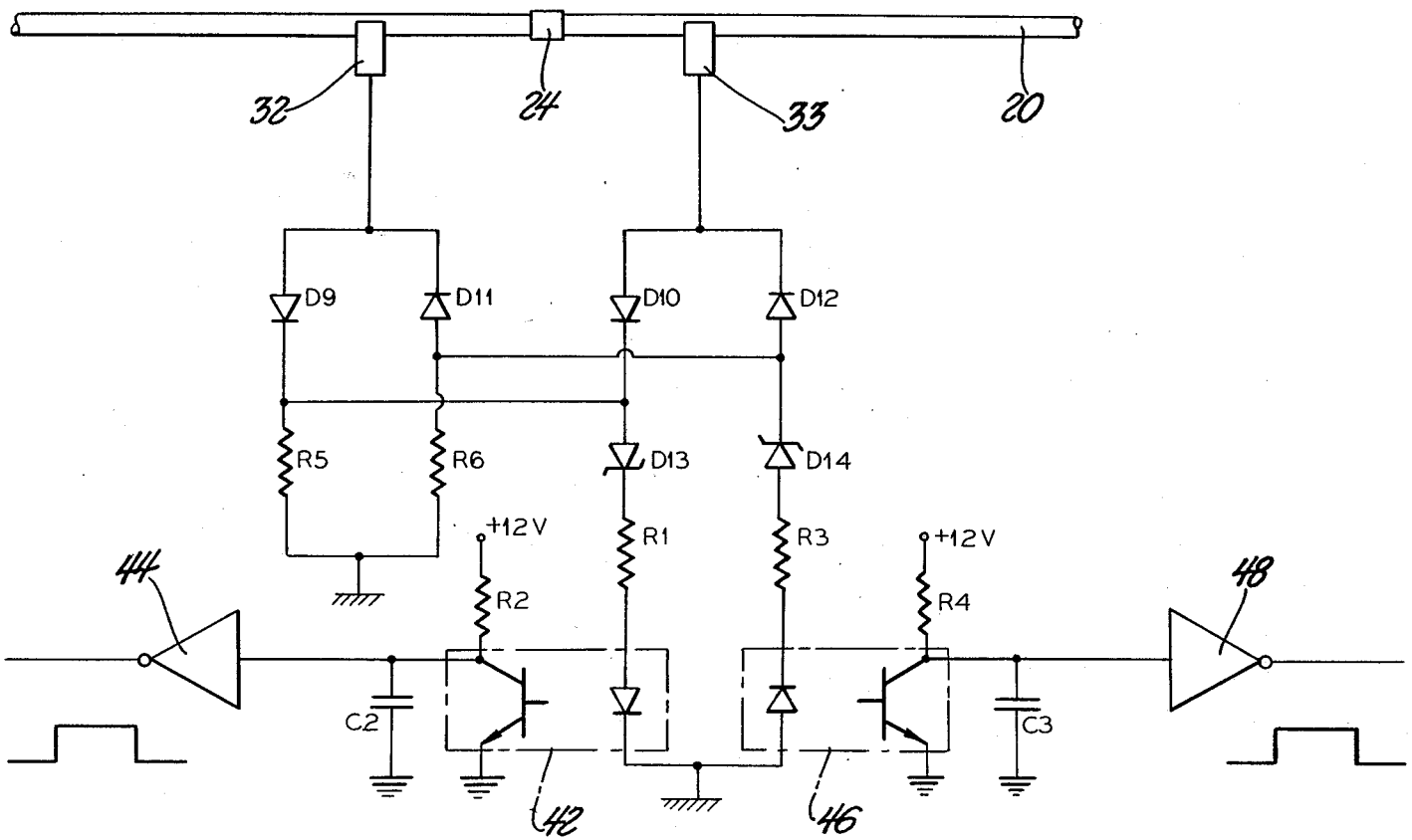
FIG. 4 is a schematic diagram of a third embodiment of the subject invention.
Figure 5:
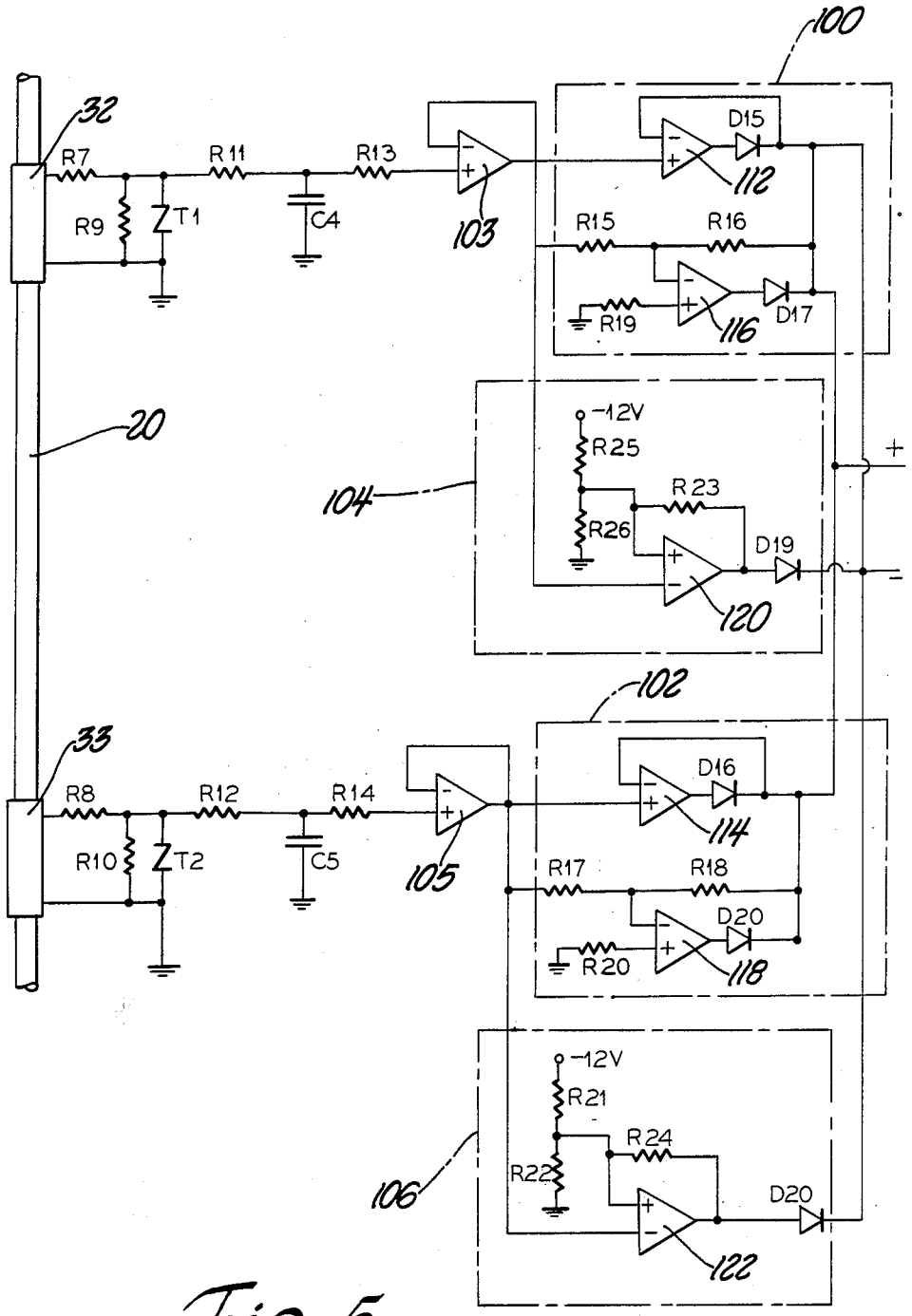
FIG. 5 is a schematic diagram of a fourth embodiment of the subject invention.
Figure 6:
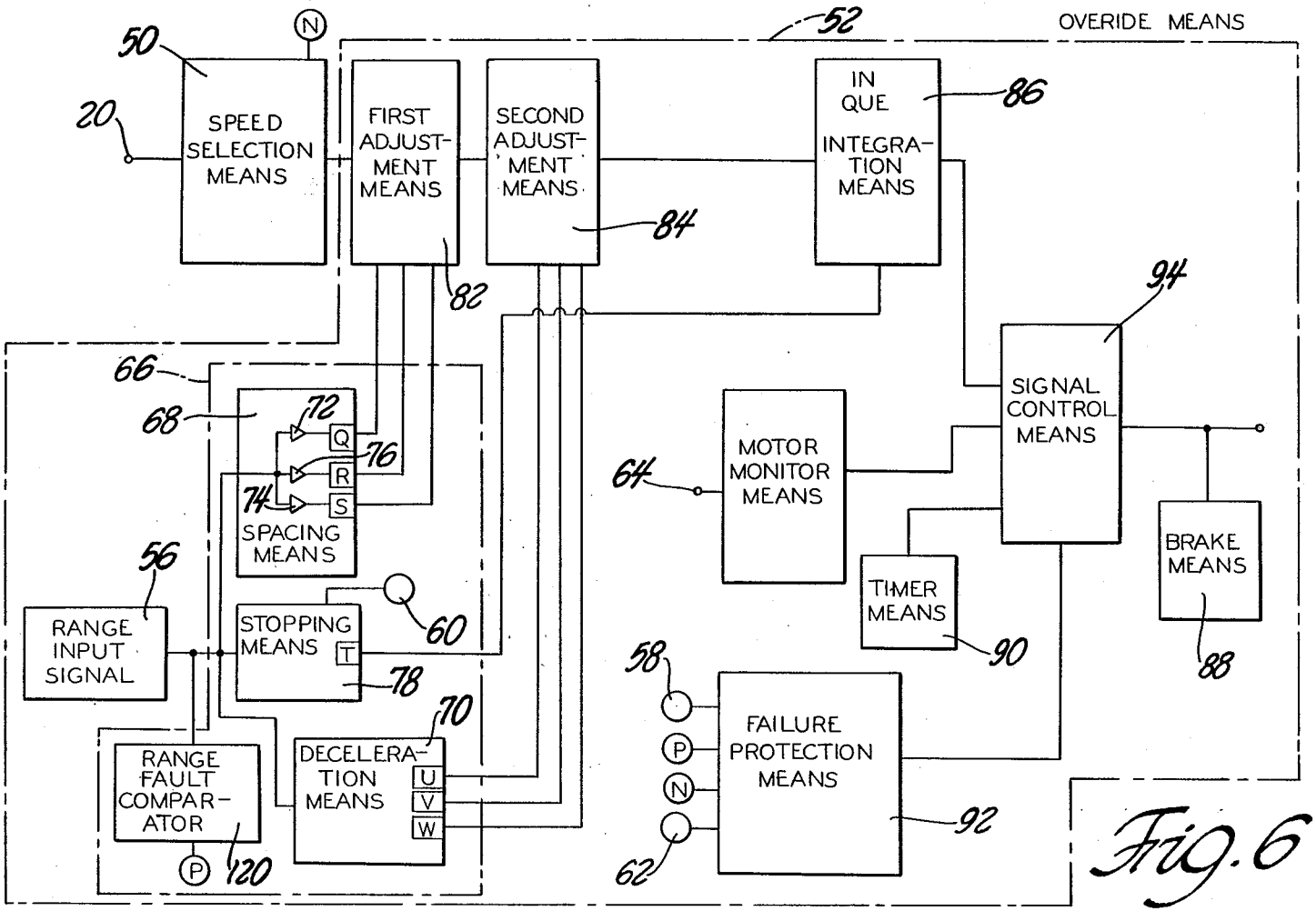
FIG. 6 is a block diagram of the control system of the subject invention.

The third embodiment FIG. 4 includes a conducting means 20 for transmitting a half-wave digital signal to the vehicle 12 having positive and/or negative polarity half-waves. The diode logic 34 includes a positive D9, D10 and negative D11, D12 polarity diode connected to each of contacting pads 32, 33 with the anodes of the positive polarity diodes D9, D10 of each contacting pad 32, 33 connected to produce a positive pulse signal and the cathodes of the negative polarity diodes D11, D12 of the contacting pads 32,33 connected to produce a negative pulse signal. The anode of the first positive polarity diode D9 is connected through resistor R5 to ground, and the method of the first negative polarity diode D11 is connected through resistor R6 to ground. The anodes of the positive polarity diodes D9, D10 are connected to a zener diode D13 and through a resister R1, to an opto-isolator 42 having its collector connected through a resistor R2 to power and to a capacitor C2 to ground and with its emitter connected to ground, and to a schmitt trigger 44 to produce a first bit of the binary coding. The cathodes of the negative polarity diodes D11, D12 are connected to a zener diode D14, through a resister R3, to the opto-isolator 46, with its collector connected through a resistor R4 to power and to a capacitor C3 to ground and its emitter connected to ground, and to a schmitt trigger 48 to produce a second bit of binary coding for representing requested speed.

The fourth embodiment FIG. 5 includes conducting means 20 for transmitting an analog command signal to the vehicle 12 wherein its magnitude indicates the requested speed or the speed the vehicle 12 is to move and the polarity indicates the forward or reverse direction. The vehicle 12 includes the two contacting pads 32, 33 for electrical connection to the rail 20 to provide the command signal. The receiver means 34 includes positive rectifier means 100, 102 for supplying and producing a positive or forward directional command signal and negative rectifier means 104, 106 for supplying and producing a negative or reverse directional command signal. The receiver means 34 includes a first resistor R7, R8 connecting to each of the contacting pads 32, 33 to a second resistor R9, R10 to ground. A transient suppressor T1, T2 is connected to the resistors R7, R8, R9, R10 through a third resistor R11, R12 and through capacitor C4, C5 to ground. A unity gain amplifier 103, 105 is connected through resistor R13, R14 to the third resistors R11, R12. The positive rectifier means 100, 102 receives the output of the unity gain amplifier 108, 110 and is connected to a second unity gain amplifier 112, 114 to diode D15, D16 and is connected to a resistive voltage divider R15, R16, R17, R18 to the inverting input of operational amplifier 116, 118 having its noninverting input connected to ground through resistor R19, R20 to diode D17, D18. The outputs of diodes D15, D16 and diodes D17, D18 are connected for producing the positive or forward command signal. The negative rectifier means 104, 106 receives the output of the unity gain amplifier 108, 110 and is connected to the inverting input of op-amp 120, 122 having its noninverting input connected to voltage divider R19, R20, R21, R21 and feedback resistor R23, R24 to diode D19, D20 producing the negative or reverse command signal.

For overall operation as indicated in FIG. 5, the control means 26 of the vehicle may be a system as disclosed in U.S. patent application Ser. No. 028,793 filed Mar. 23, 1987 and assigned to the assignee of the subject application, and as will be generally described herein. The control means 26 includes speed selection means 50 which interprets the requested speed from the command signal to produce a speed signal indicative of the requested speed. The speed selection means 50 receives the analog signal and determines requested speed by the magnitude of the signal, and forward and reverse by the polarity of the signal. Alternatively, the speed selection means 50 receives the digital signal and decodes each half-wave into one bit of information in the form of binary coding wherein the binary coding determines the requested speed and one bit thereof indicates the forward or reverse direction. The speed selection means 50 receives the analog or digital signal and produces the speed signal.

The control means 26 includes override means 52 for receiving the speed signal to override and change the speed signal to drive the motor 16. In other words, under certain sensed conditions as will be subsequently described, the speed of the vehicle 12 may need adjusting. The override means 52 includes sensor input means for sensing external activity for proper operation of the control means 26. The sensor input means includes a range sensor input signal 56 which measures the distance to an adjacent vehicle 12. The input means also includes a trip input 58, an in que input 60, an overload input 62, and a motor monitor input signal 64. The trip input 58 monitors the temperature on heat sinks inside the drive and produces a trip input signal. The temperature rises and can overheat when the monitor demands more power than the drive can five, i.e., increased load or duty cycle. The in que input 60 is a short range sensor which produces and in que input signal to stop a vehicle 12 to prevent an immediate collision. The in que sensor 60 is optical isolated with a ten millisecond time constant. It is actuated by opening the circuit which is tied to interface common or by the que comparator in the stopping means. The overload input 62 is a switch in the windings of the motor 16 for sensing overheating of the motor 16 and producing an overload input signal. The motor monitor input signal 64 senses the speed the motor 16 is turning at and moving the vehicle 12.

The override means 52 includes tracking means 66 which prevents collisions by maintaining spacing of the vehicles 12. The tracking means 66 includes spacing means 68 for maintaining a predetermined distance between vehicles 12 so that a first vehicle 12 will run at the requested speed and an adjacent trailing vehicle 12 will vary its speed to maintain the predetermined distance. The tracking means 66 also includes deceleration means 70 for slowing the vehicle 12 by a variable percentage to prevent a collision and for running the vehicle 12 at the requested speed unless the vehicle 12 senses another vehicle 12 within at least one forward predetermined distance. Therefore, the override means 52 may control the speed of the vehicles 12 as a total dependency on a first vehicle 12 by continuously maintaining a predetermined distance between vehicles 12, or each vehicle 12 component values used. For example, the comparing circuits may increase or decrease the speed of the vehicle 12 by ten percent for a time period in order for the vehicle 12 to resume to the predetermined distance. A lagging comparator 72 is set when the vehicle 12 is lagging in the predetermined distance which causes to be produced a positive adjustment signal (Q) to increase the speed by the programmed percentage. A leading comparator 74 is set when the vehicle 12 is leading on the predetermined distance and causes to be produced a negative adjustment signal (S) to decrease the speed by the programmed percentage. A base comparator 76 detects whether a vehicle 12 is within the field at all. A base signal (R) is produced to indicate that no vehicle 12 is present in order to act as the lead vehicle 12 and run at the requested speed. The leading 74 and lagging comparators 72 are active only when the enable spacing input (J) is activated, which will be described subsequently.

Also included is stopping means 78 which produces a stop signal (T) for stopping the vehicle 12 when another vehicle 12 is within a stop distance which is less than the distances required to activate the spacing means 66 and deceleration means. The stopping means 78 is activated by the in que input signal (60) or range sensor input signal 56, wherein the motor monitor means 80 applies the brake. This is a short distance monitor which will quickly slow the vehicle 12 and apply the brake to prevent collision and further damage. The stopping means uses a que comparator to receive the range sensor and produce the stopping signal (T) when within the stop distance. The stopping means 78 is always active.

The override means 52 includes adjustment means 80 for adjusting said requested speed in response to the tracking means. The adjustment means 80 includes first adjustment means 82 producing a first adjusted signal (B) for adjusting the drive signal representative of requested speed to the motor 16 by adding and subtracting magnitudes from the speed select signal in response to the spacing means. Therefore, the first adjustment means 82 will either increase or decrease the speed of the vehicle 12 by the first or second programmed percentages or allow the vehicle 12 to run at the base speed. The first adjustment means 82 is directly controlled by the spacing means 68.

The adjustment means 80 includes second adjustment means 84 for receiving the first adjusted signal (B) and producing a second adjusted signal for changing the speed of the vehicle 12 by the first and second percentages or setting the speed of the vehicle 12 to a user programmed rate in response to the deceleration means. If the NO DECEL signal (W) was received from the deceleration means then there is no adjustment to the first adjusted signal (B). The first (B) and second adjusted signals may be equal to the speed select signal if no changes in the signal occurred within the first and second adjustment means. A jumper selects one of two modes responsive to the first deceleration comparator. When the first mode is selected, the speed of the vehicle 12 is dropped to a user specified percentage. When the second mode is selected, the speed of the vehicle 12 is dropped to a user specified percentage of the requested speed or a fixed user programmed rate.

The override means 52 includes an in que integration means 86 which receives the in que signal (T) from the tracking means and the signal from the second adjustment means 84 and will drop the speed select signal to approximately 0 Volts when the in que signal (T) is activated in order to stop the vehicle 12 to prevent a collision. The output of the in que integration means 86 provides the drive signal to the motor 16. This signal indicates the exact speed that the motor 16 is to presently run at.

Braking means 88 is for stopping the vehicle 12. The braking means 88 will stop the vehicle 12 to prevent a collision in emergencies. Also included is motor monitor means 80 for dynamically braking the vehicle 12 when the speed of the motor 16 falls below a predetermined speed. In other words, the motor monitor means 80 monitors the motor 16 and when the motor 16 voltage indicated by the motor monitor input falls below a voltage indicative of the predetermined speed, such as 0.4 volts, the brake 80 is actuated to stop the vehicle 12. The relay to the brake 88 is continuously energized to keep the brake 88 open, so that deenergization will actuate the brake 88. A timer means 90 will hold the initiation of the brake 88 for a predetermined time between zero and 30 seconds at which point the run signal is turned off and the brake 88 is applied. The timer means 90 ensures that the brake 88 is not applied when also driving the motor 16. The run integration means FIG. 3 includes timer means 90 for delaying actuation of the brake 88 until a predetermined time following the motor monitor 80 going to zero, representing movement. Dynamic breaking is accomplished by applying a dc current to the motor 16 windings at which oppose turning.

Further included is failure protection means 92 for stopping the vehicle 12 in response to a failure in the control means 26 or from the sensor input means 54. The failure protection means 92 receives the range fault signal (P) of the tracking means FIG. 4, the trip input signal (58), a command fault signal (N), and the overload input signal (62). The command fault signal (N) indicates that a command signal below a voltage indicative of a command has been received, or in other words, there is no command signal on the rail 20.

Also included is signal control means 94 for OR-ing the drive signal, motor monitor means signal and timing means signal to produce a command run signal. The command run signal is combined with the failure protection means signal, and when either signal goes low, an OFF run signal 36 is generated. Only, when both signals are high will the run signal 36 remain ON.

Therefore, as long as the motor 16 is active, and there is a drive signal, and the failure protection means 92 has not been activated, a run signal will be produced indicating the motor 16 is to be ON. If the drive signal and the motor monitor means signal 80 after the timer means 90 has delayed indicate no movement of the vehicle 12, then the run signal will turn OFF the motor 16. If in any case the failure protection means 90 is active, the motor 16 will be turned OFF.

In overall performance, the override means 52 receives the speed select signal for use in the first and second adjustment means 82, 84 which is controlled by the tracking means 66 which produces the adjusted signal. The in que integration means 86 first receives the adjusted signal from the first 82 and second 84 adjustment means. The in que integration means 86 means then incorporates the in que input signal (T) from the tracking means 66 to produce the drive signal indicative of the speed the vehicle 12 is to move at. This drive signal is sent to the inverter 24. The drive signal, the motor monitor means signal 80, and the timer means signal 84 are incorporated with the failure protection means signal 92 in the run integration means.

The drive signal drives the motor 16 and is indicative of the speed the vehicle 12 is to move at. The speed is no longer a mirror image of the requested speed, though it may be. The presence of other vehicles and safety measures can alter the requested signal to the command signal. The run signal either turns the motor 16 ON or OFF. Therefore, both the drive signal and run signal 36 need both be present in order for the vehicle 12 to move. Just before the run signal is turned OFF, the command signal goes to zero and dynamic braking is used to eliminate wear on the braking means 88. When the drive signal goes to zero, the drive is stopped. The motor monitor input signal 80 will be set as the motor 16 slows to below the predetermined magnitude. At that point, the timer means 90 is actuated after which the run signal is turned OFF.

Also included is a method of moving a vehicle about a track having a conductive rail for transmitting an electrical signal and the rail comprised of isolated sections of rail separated by buffers (24) therebetween with each isolated section of rail supplied with the electrical signal. The steps include electrically contacting the rail at least two positions spaced a distance apart allowing a continuous electrical connection with the rail, receiving the electrical signal from each position, preventing back feeding of received electrical signals to either position. A first embodiment includes receiving positive polarity and negative polarity DC power, receiving the positive polarity DC power from each position to produce a positive DC signal, and receiving the negative polarity DC power from each position to produce a negative DC signal. A second embodiment includes receiving AC power off the rail, and rectifying the AC power received off the rail to produce a power signal. A third embodiment includes receiving a half-wave digital signal having positive and negative polarity half-waves off the rail, receiving the positive half-wave to produce one bit of binary coding and receiving the negative half wave to produce a second bit of binary coding. A fourth embodiment includes receiving an AC control signal having its magnitude representing the speed the vehicle is to move and its polarity representing the direction the vehicle is to move, rectifying the AC control signal from each position and combining to produce a forward direction command signal, and rectifying the AC control signal from each position and combining the produce a reverse direction command signal.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A conveyor assembly including a vehicle (12) for moving about a track (18), said assembly comprising: vehicle (12) being mobile along the track (18), conductive means (20) along the track (18) for supplying an electrical signal to said vehicle (12), said conductive means (20) comprising isolated sections of rail each transmitting an electrical signal and having buffers (24) between each isolated section for preventing electrical conduction therebetween, and said vehicle (12) including at least two contacting pads (32, 33) placed a distance apart and in contact with said conductive means such that at least one contacting pad is in electrical connection with said rail and including receiver means (34) connected between said contacting pads (32, 33) for receiving the electrical signal from each of said contacting pad (32, 33) and for preventing back feeding of received electrical signals to either contacting pad (32, 33).

2. An assembly as set forth in claim 1 further characterized by said receiver means (34) including diode logic to receive said electrical signal on one of said contacting pads (32, 33) and prevent back feeding to the other of said contacting pads.

3. An assembly as set forth in claim 2 further characterized by said conductive means (20) including two conductive rails (20) for transmitting positive polarity and negative polarity dc power to said vehicle (12).

4. An assembly as set forth in claim 3 further characterized by said receiver means (34) including positive power supply receiver means (36) for receiving power off the positive polarity conductive rail and negative power supply receiver means (38) for receiving power off the negative polarity conductive rail.

5. An assembly as set forth in claim 4 further characterized by said positive power supply receiver means (36) including a positive polarity diode (D1, D2) connected to each conducting pad (32, 33) with their anodes connected to produce a positive power signal to said vehicle (12).

6. An assembly as set forth in claim 5 further characterized by said negative power supply receiver means (38) including negative polarity diode (D3, D4) connected to each conducting pad (32, 33) with their cathodes connected to produce a negative power signal to said vehicle (12).

7. An assembly as set forth in claim 2 further characterized by said conductive means (20) comprising at least two rails for transmitting AC power to said vehicle (12).

8. An assembly as set forth in claim 7 further characterized by said diode logic including full wave rectifier (40) for rectifying the AC power signal.

9. An assembly as set forth in claim 8 further characterized by said full wave rectifier (40) comprising first and second positive polarity diodes (D5, D6) with their anodes connected to supply the positive rectified signal to said vehicle (12) and with a cathode connected to one of said conducting pad (32, 33) and first and second negative polarity diodes (D7, D8) with their anodes connected to one of said conducting pads (32, 33) and their cathodes connected to supply the negative rectified signal to said vehicle (12).

10. An assembly as set forth in claim 9 further characterized by said conductive means (20) including three rails for transmitting three phase AC power, said diode logic including said full wave rectifier (40) for each of three phases of power signal with each phase transmitted on a separate rail and having said positive rectified signals connected and said negative rectified signals connected to supply power to said vehicle (12).

11. An assembly as set forth in claim 2 further characterized by said conductive means (20) including one rail transmitting a half wave digital signal to said vehicle (12) having positive and negative polarity half-waves.

12. An assembly as set forth in claim 11 further characterized by said diode logic (34) including a negative and positive polarity diode (D9, D11, D10, D10) connected to each of said contacting pads (32, 33), and said anodes of said positive polarity diodes (D9, D10) of the contacting pads (32, 33) connected to produce positive pulses and said cathodes of said negative polarity diodes (D11, D12) of the contacting pads (32, 33) connected to produce negative pulses.

13. An assembly as set forth in claim 2 further characterized by said conductive means (20) including at least one rail for transmitting AC control signal having its magnitude representing the speed the vehicle is to move and its polarity representing the direction said vehicle (12) is to move.

14. An assembly as set forth in claim 13 further characterized by said logic means including positive rectifier means (100, 102) for receiving a signal from each of said contacting pads (32, 33) to produce a forward direction command signal and negative rectifier means (104, 106) for receiving a signal from each of said contacting pads (32, 33) to produce a reverse direction command signal.

15. A conveyor vehicle (12) assembly for moving about a track (18) including a conductive rail for transmitting an electrical signal and the rail comprised of isolated sections of rail separated by buffers (24) therebetween with each isolated section of rail supplied with the electrical signal, said assembly comprising: vehicle (12) being mobile about the track (18); said vehicle (12) including at least two contacting pads (32, 33) spaced a distance apart and in contact with the track such that at least one contacting pad is in electrical connection with the rail, and including receiver means (34) connected between each of said contacting pads (32, 33) for receiving the electrical signal from each contacting pad (32, 33) and for preventing back feeding of received electrical signals to either contacting pad.

16. An assembly as set forth in claim 15 further characterized by said receiver means (34) including diode logic to receive said electrical signal on one of said contacting pads (32, 33) and prevent feedback to the other of said contacting pads.

17. An assembly as set forth in claim 16 further characterized by said receiver means (34) receiving positive polarity and negative polarity dc power.

18. An assembly as set forth in claim 17 further characterized by said receiver means (34) including positive power supply receiver means (36) for receiving power off the positive polarity conductive rail and negative power supply receiver means (38) for receiving power off the negative polarity conductive rail.

19. An assembly as set forth in claim 16 further characterized by said receiver means (34) receiving AC power.

20. An assembly as set forth in claim 19 further characterized by said diode logic (34) including full wave rectifier (40) for rectifying the AC power signal.

21. An assembly as set forth in claim 16 further characterized by said receiver means (34) receiving a half wave digital signal having positive and negative polarity half-waves.

22. An assembly as set forth in claim 21 further characterized by said diode logic (34) including a reverse and forward biased diodes (D9, D11, D10, D12) connected to each of said contacting pads (32, 33), and said anodes of said forward biased diodes (D9, D10) of the contacting pads connected to produce positive pulses and said cathodes of said reverse biased diodes (D11, D12) of the contacting pads (32, 33) connected to produce negative pulses.

23. An assembly as set forth in claim 16 further characterized by said receiver means (34) receiving AC control signal having its magnitude representing the speed the vehicle is to move and its polarity representing the direction said vehicle (12) is to move.

24. An assembly as set forth in claim 23 further characterized by said logic means (34) including positive rectifier means (100, 102) for receiving a signal from each of said contacting pads (32, 33) to produce a forward direction command signal and negative rectifier means (104, 106) for receiving a signal from each of said contacting pads (32, 33) to produce a reverse direction command signal.

25. A method of moving a vehicle about a track having a conductive rail for transmitting an electrical signal and the rail comprised of isolated sections of rail separated by buffers (24) therebetween with each isolated section of rail supplied with the electrical signal, the method comprising the steps of; electrically contacting the rail at least two positions spaced a distance apart allowing a continuous electrical connection with the rail, receiving the electrical signal from each position, and preventing back feeding of received electrical signals to either position.

26. A method as set forth in claim 25 further characterized by receiving positive polarity and negative polarity DC power.

27. A method as set forth in claim 26 further characterized by receiving the positive polarity DC power from each position to produce a positive DC signal, and receiving the negative polarity DC power from each position to produce a negative DC signal.

28. A method as set forth in claim 25 further characterized by receiving AC power off the rail.

29. A method as set forth in claim 28 further characterized by rectifying the AC power received off the rail to produce a power signal.

30. A method as set forth in claim 25 further characterized by receiving a half-wave digital signal having positive and negative polarity half-waves off the rail.

31. A method as set forth in claim 30 further characterized by receiving the positive half-wave to produce one bit of binary coding and receiving the negative half-wave to produce a second bit of binary coding.

32. A method as set forth in claim 25 further characterized by receiving an AC control signal having its magnitude representing the speed the vehicle is to move and its polarity representing the direction the is to move.

33. A method as set forth in claim 32 further characterized by rectifying the AC control signal from each position and combining to produce a forward direction command signal, and rectifying the AC control signal from each position and combining to produce a reverse direction command signal.

34. A method as set forth in claim 25 further characterized by combining the electrical signal from each position producing a single signal.

35. A conveyor assembly including a vehicle (12) for moving about a track (18), said assembly comprising; vehicle (12) being mobile along the track (18), conductive means (20) along the track (18) for supplying an electrical signal to said vehicle (12), said conductive means (20) along the track (18) for supplying an electrical signal to said vehicle (12), said conductive means (20) comprising isolated sections of rail each transmitting an electrical signal and having buffers (24) between each isolated section for preventing electrical conduction therebetween, and said vehicle (12) including at least two contacting pads (32, 33) placed a distance apart and in contact with said conductive means such that at least one contacting pad is in electrical connection with said rail and including receiver means (34) connected to said contacting pads (32, 33) for receiving the electrical signal from each contact pad (32, 33) and for preventing back feeding of received electrical signals to either contact pad (32, 33), said receiver means (34) including diode logic for receiving said electrical signals on one of said contacting pads (32, 33) and for preventing backfeeding to the other of said contacting pads.

36. An assembly as set forth in claim 1 or 5 further characterized by including combining means connected to said receiver means for receiving and combining the electrical signal from each of said contacting pads (32, 33) to produce a single signal.

* * * * *